US010208367B2

(12) United States Patent
Chen

(10) Patent No.: US 10,208,367 B2
(45) Date of Patent: Feb. 19, 2019

(54) GE STAINLESS STEELS

(71) Applicant: National Tsing Hua University, Hsinchu (TW)

(72) Inventor: Swe-Kai Chen, Hsinchu (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 120 days.

(21) Appl. No.: 15/393,686

(22) Filed: Dec. 29, 2016

(65) Prior Publication Data

US 2018/0105904 A1 Apr. 19, 2018

(30) Foreign Application Priority Data

Oct. 19, 2016 (TW) ..... 105133774 A

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/18*** | (2006.01) |

(52) U.S. Cl.

CPC ..... *C22C 38/18* (2013.01); *C22C 38/002* (2013.01); *C22C 38/02* (2013.01); *C22C 38/04* (2013.01)

(58) Field of Classification Search

CPC ..... C22C 38/002; C22C 38/02; C22C 38/04; C22C 38/18

See application file for complete search history.

(56) References Cited

U.S. PATENT DOCUMENTS

| | | | | |
|---|---|---|---|---|
| 8,071,017 | B2 * | 12/2011 | Fedchun | C22C 38/04 148/326 |
| 2009/0196784 | A1 * | 8/2009 | Fedchun | C22C 38/04 420/61 |
| 2015/0152530 | A1 * | 6/2015 | Sagara | C21D 8/10 420/40 |
| 2015/0354038 | A1 * | 12/2015 | Kinugasa | C22C 38/00 420/38 |
| 2016/0237534 | A1 * | 8/2016 | Chen | C22C 38/18 |

* cited by examiner

*Primary Examiner* — Cam N. Nguyen
(74) *Attorney, Agent, or Firm* — Locke Lord LLP; Tim Tingkang Xia, Esq.

(57) ABSTRACT

A Ge-containing stainless steel is disclosed. The disclosed Ge-containing stainless steel is principally composed of Fe and Cr. Pitting corrosion is significantly reduced when a certain amount of Ge is added. When more Ge is added, the pitting corrosion is reduced to a minimum level.

2 Claims, 7 Drawing Sheets

| Components | Fe | Cr | Mn | Si | Ge |
|---|---|---|---|---|---|
| 430 | 79.88 | 19.12 | 0.54 | 0.46 | --- |
| 430G0.16 | 79.41 | 19.41 | 0.58 | 0.44 | 0.16 |
| 430G0.46 | 79.34 | 19.15 | 0.62 | 0.44 | 0.46 |
| 430G0.59 | 79.11 | 19.22 | 0.65 | 0.43 | 0.59 |
| 430G0.83 | 78.69 | 19.37 | 0.67 | 0.44 | 0.83 |
| 430G1.02 | 78.22 | 19.73 | 0.66 | 0.38 | 1.02 |
| 430G2.17 | 77.68 | 18.78 | 0.74 | 0.66 | 2.17 |
| 430G3.81 | 76.07 | 18.51 | 0.83 | 0.78 | 3.81 |
| 430G6.26 | 73.52 | 19.03 | 0.75 | 0.60 | 6.26 |
| 430G8.72 | 71.27 | 18.75 | 0.53 | 0.73 | 8.72 |

(Unit:wt %)

GE STAINLESS STEELS

CROSS REFERENCE TO RELATED APPLICATION

This application is related to and claims priority under 35 U.S.C. § 119(a) to Taiwan Patent Application No. 105133774 filed in the Taiwan Intellectual Property Office on Oct. 19, 2016, the entire content of which is incorporated herein by reference.

BACKGROUND OF THE INVENTION

1. Field of the Invention

The disclosure is related to a Ge-containing stainless steel, and more particularly, to a Ge-containing stainless steel made from the main components of iron and chromium with the addition of different amount of germanium.

2. Descriptions of the Related Art

In the development of industrial technique, metal has become an indispensable material, which is used in daily necessities, tools and equipment. However, corrosion of metal is inevitable when the metal is placed in the ambient environment, which leads to deterioration of properties of the metal, such as aging and degeneration. This not only causes inconvenience for the usage, but also raises the issue of environment pollution and industrial accidents, which could jeopardize people's life safety.

In order to reduce the loss from the metal corrosion, improving corrosion resistance of alloy has become an important issue. Common industrial methods include using corrosion resistant stainless steel, surface coating, anodic protection, cathodic protection and so forth. The most essential method is using stainless steel to deal with corrosive surroundings. According to different needs and various environments, different stainless steels with distinct properties are used. Therefore, the development of stainless steel has branched out.

When the classification is based on different added elements, or more precisely on alloy containing different amount of nickel and chromium, four main types of stainless steels, which are chromium based alloy, chromium-nickel based alloy, chromium-nickel-manganese based alloy and low chromium based alloy, have been widely used. Their respective properties are as the followings:

(1) Chromium based type: mainly 400 series contains no nickel or lower than 2.5 wt % of nickel. Martensitic stainless steel and ferritic stainless steel belong to this type.

(2) Chromium-nickel based type: mainly 300 series contains austenitic stainless steel and 600 series precipitation hardened stainless steel. Austenitic microstructure is stabilized by the added nickel. It is the most common stainless steel in the market.

(3) Chromium-nickel-manganese based type: mainly 200 series is altered from 300 series by having nickel replaced by cheaper manganese. This is another type of cheap austenitic stainless steel.

(4) Low chromium based type: mainly 500 series is with only 4 to 6 wt % of chromium, and technically it does not necessary fall into the strictest definition of stainless steel. The price is low, and it is mainly applied in petrochemical industry.

However, there are many other classifications of stainless steel. From microstructure perspectives, there are five major groups: austenitic series, ferritic series, martensitic series, precipitation hardening series and duplex series stainless steel. Regarding the alloy content in stainless steel, different categories correspond to different ratios, such that their corrosion resistance and mechanical properties are different. Thus, it is important to clarify the influences of alloy element on stainless steel. For example, adding chromium and nickel can improve the corrosion resistance, and adding niobium and titanium can reduce intergranular corrosion while adding aluminum can improve mechanical properties.

Common stainless steel is mainly the austenitic stainless steel including a great amount of nickel. Nickel is a FCC phase stabilizer. The addition of nickel could transform stainless steel to a FCC structure with better mechanical properties, which improves its usability. For instance, the 304 stainless steel with its high corrosion resistance, high ductility and good weldability can be used in nearly any kinds of environments. However, since the demand of the stainless steel steadily increases the demand of nickel grows rapidly. Thus, the price of nickel is a dominant factor in affecting the price and sale volume of stainless steel. Therefore, researches of stainless steel in recent years are gradually shifted to replacing nickel with a minute amount of other elements so as to reduce the reliance of nickel and at the same time maintain or even lower the production cost of stainless steel without sacrificing the corresponding performance in corrosion resistance, weldability and formability.

Thus, the selected minute amount of element must be associated with characteristics of the reduced cost, better properties compared with nickel in corrosion resistance, weldability and formability. Besides, stainless steel made of conventional compositions tends to suffer from pitting corrosion with one or more pits in chloride-containing surroundings. Therefore, conventional stainless steel does not necessarily meet the requirement when used in sea water. Thus, it would be a better alternative if stainless steel with different compositions could be developed to resist the pitting corrosion.

SUMMARY OF THE INVENTION

A Ge-containing stainless steel, which is a Ge-containing ferritic stainless steel material made from a raw material, is disclosed. The composition of the raw material may include: 16~25 wt % of Cr, 0.1~1 wt % of Mn, 0.1~1 wt % of Si, 6~12 wt % of Ge and the rest is Fe.

In one embodiment, there is no pitting corrosion after the Ge-containing stainless steel is immersed in a sodium chloride solution.

A Ge-containing stainless steel, which is a Ge-containing ferritic stainless steel material made from a raw material, is disclosed. The composition of the raw material may include: 0~16 wt % of Cr, 0.1~1 wt % of Mn, 0.1~1 wt % of Si, 0.1~20 wt % of Ge and the rest is Fe.

In another embodiment, there is no pitting corrosion after the Ge-containing stainless steel is immersed in a sodium chloride solution.

DETAILED DESCRIPTION OF THE PREFERRED EMBODIMENTS

The technical solutions, features and effects of the disclosure can be clearly described in the description of embodiments referring to the figures.

Figure 1:
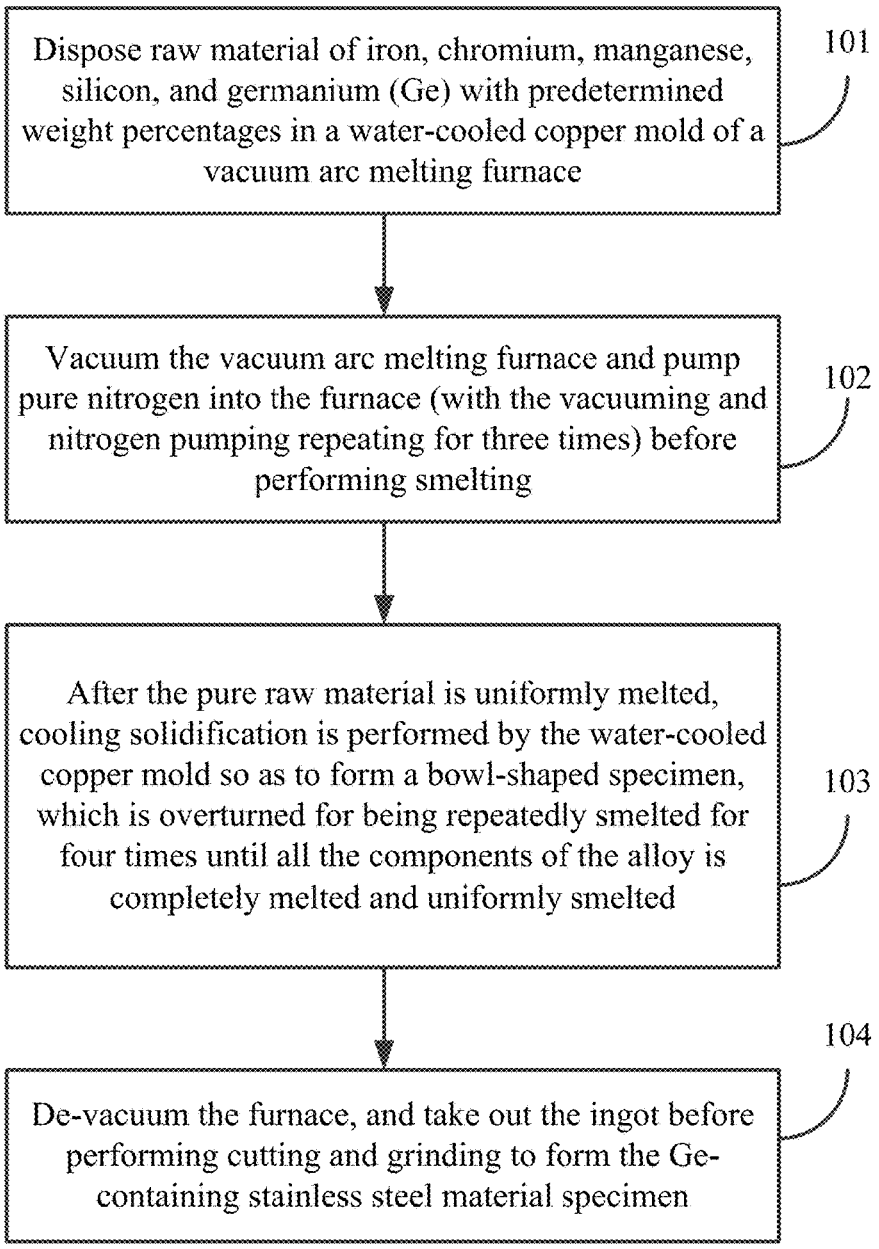
FIG. 1 is a flow chart of the method for making the Ge-containing stainless steel according to the disclosure.
Figures 2, 3:
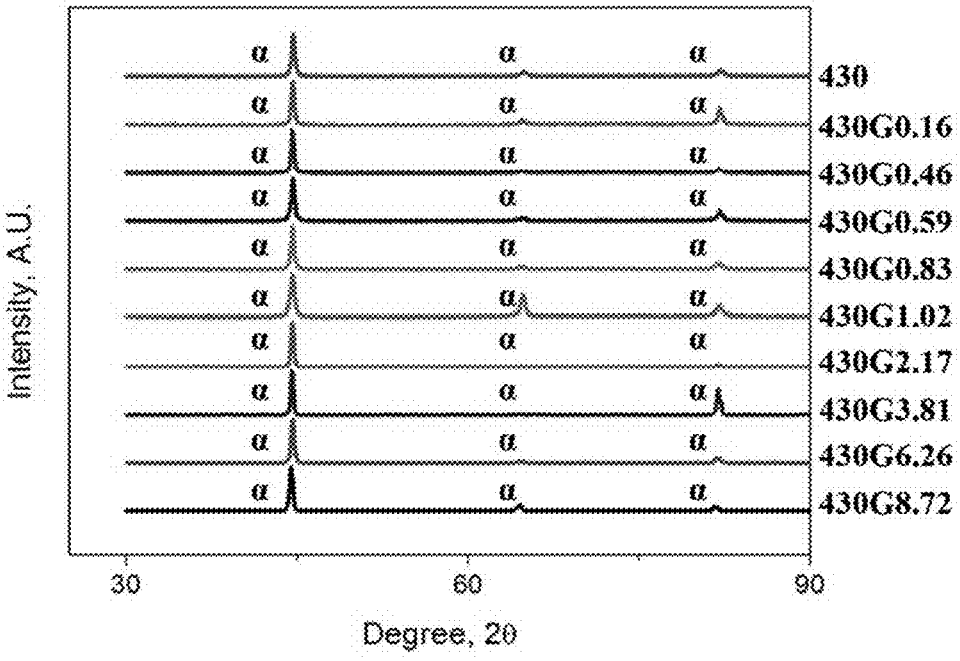
FIG. 2 is a schematic diagram of the composition according to the Ge-containing stainless steel of the disclosure.
FIG. 3 is a schematic diagram of the XRD analysis according to the Ge-containing stainless steel of the disclosure.

Referring to FIG. 1, in one embodiment iron (Fe), chromium (Cr), manganese (Mn), silicon (Si) are used as the main components and germanium (Ge) is slightly added (the compositions of the embodiments are shown in FIG. 2). The above raw material is made to form the stainless steel material by melting. Before the melting is to be performed, the raw material should be disposed on a water-cooled copper mold of a vacuum arc melting furnace (step 101); after the vacuum arc melting furnace is capped by the cover thereof, the cavity of the vacuum arc melting furnace is pumped to $2.4\times10^{-2}$ torr, before pure nitrogen is added to 8 torr. Such pumping and nitrogen adding may be repeated for three times before any smelting is performed by the vacuum arc melting furnace (step 102).

In the vacuum arc melting furnace, after the pure raw material is uniformly melted by the vacuum arc, cooling solidification is performed by the water-cooled copper mold so as to form a bowl-shaped specimen. The specimen is overturned for being repeatedly smelted four times until all the components of the alloy could be completely melted and uniformly smelted (step 103). The ingot, which is the casting state of CS alloy, is taken out after the furnace is devacuumed, and then the Ge-containing stainless steel material specimen is formed after cutting and grinding (step 104).

Afterwards, in order to reduce the impact of voids and micro segregation in the alloy, a thermal treatment is applied under 1100° C. to the Ge-containing stainless steel material specimen. Before the thermal treatment, the smelted casting state specimen is sealed in a quartz tube, which may be heated to 1100° C. with a heating rate of 4.5° C./min. The quartz tube may be placed in the same 1100 degrees Celsius for 6 hours before being taken out and treated with water quenching treatment. After the temperature of the specimen in the tube is lowered to the room temperature, the sealed quartz tube is broken and the specimen is taken out, at which point the alloy specimen could be at its homogeneous state.

According to the disclosure, the Ge-containing stainless steel material specimen is analyzed by different electrochemical experiments and corrosion solution tests. As shown in FIG. 3, there are no significant influences to the original crystal structure of the alloy with the addition of germanium, which is within the scope of the disclosure, and the single phase remains as a BCC in structure (although it is not shown in the figure, according to the embodiments, the addition of 20 wt % of germanium does not result in any structural change. In other words, the crystal structure of the alloy with 20 wt % of germanium remains as a BCC in structure.

Figure 4A:
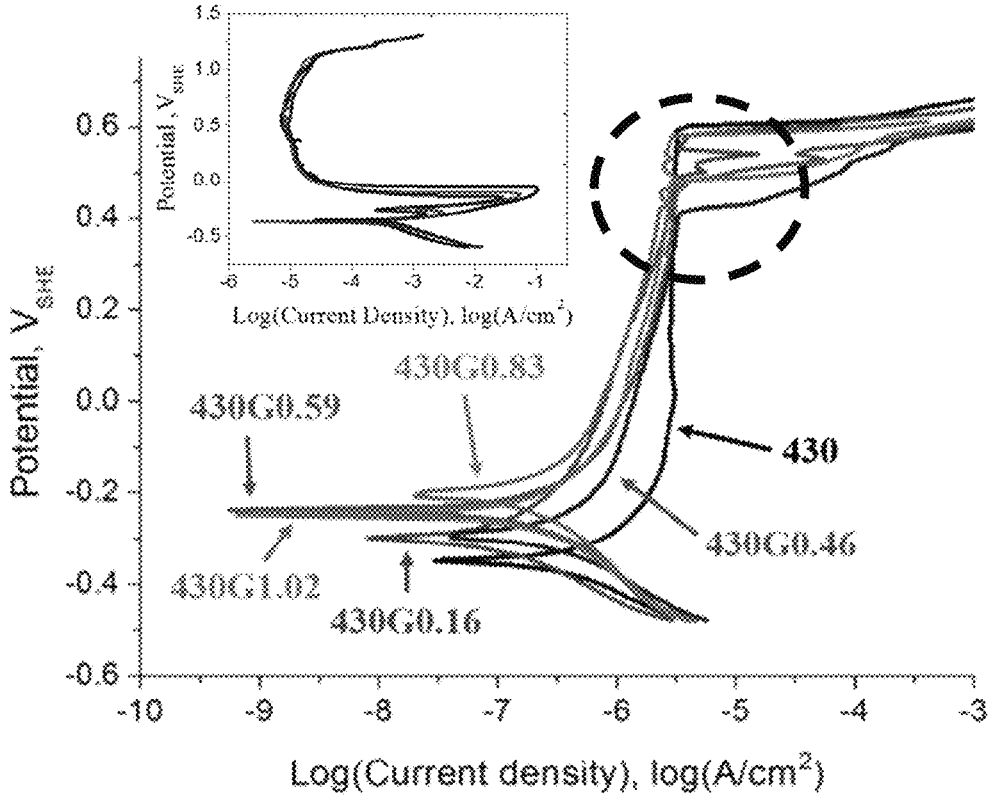
FIG. 4A is a schematic diagram of the polarization curve according to the Ge-containing stainless steel of the disclosure.
Figure 4B:
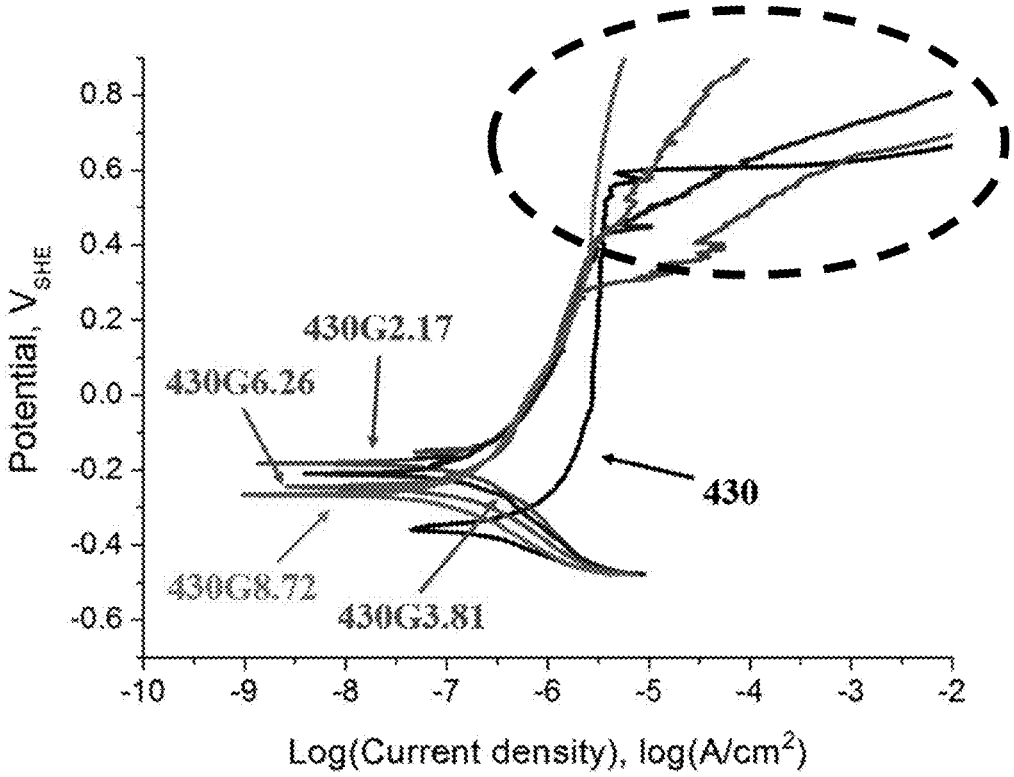
FIG. 4B is a schematic diagram of the polarization curve according to the Ge-containing stainless steel of the disclosure.
Figure 4C:
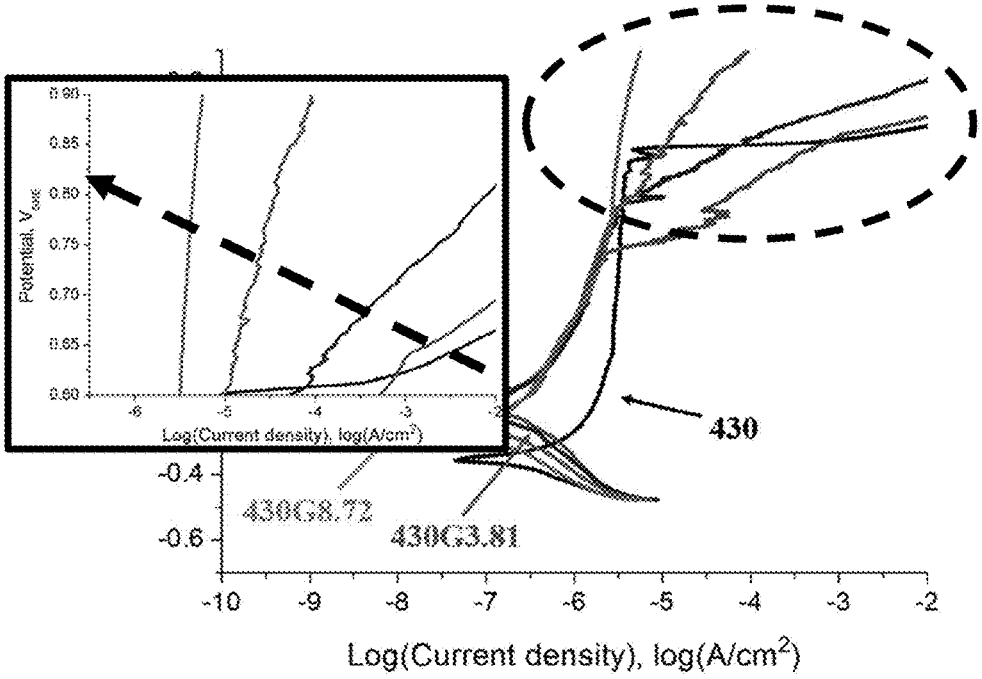
FIG. 4C is a schematic diagram of the polarization curve according to the Ge-containing stainless steel of the disclosure.

Corrosion tests are applied to the above alloy and they are analyzed by linear polarization method. As shown in FIGS. 4A~4C, results of the tests are:

(1) Under a sodium chloride environment, as compared to a sulfuric acid environment, the current density does not significantly decrease with passivation, instead, it increases at a slower rate;

(2) When the addition of germanium is low, there is tremble in the curve, and since it is difficult to form passivation films under a chloride-containing environment, the curve of the current density may vibrate; and (3) The corrosion voltage before the addition of germanium is close to −0.4 V, and the entire active section moves to the top left with the addition of germanium, as evidenced by the curve of 430G8.72 being the most significant curve that does not tremble and moves toward to top left.

Figure 5A:
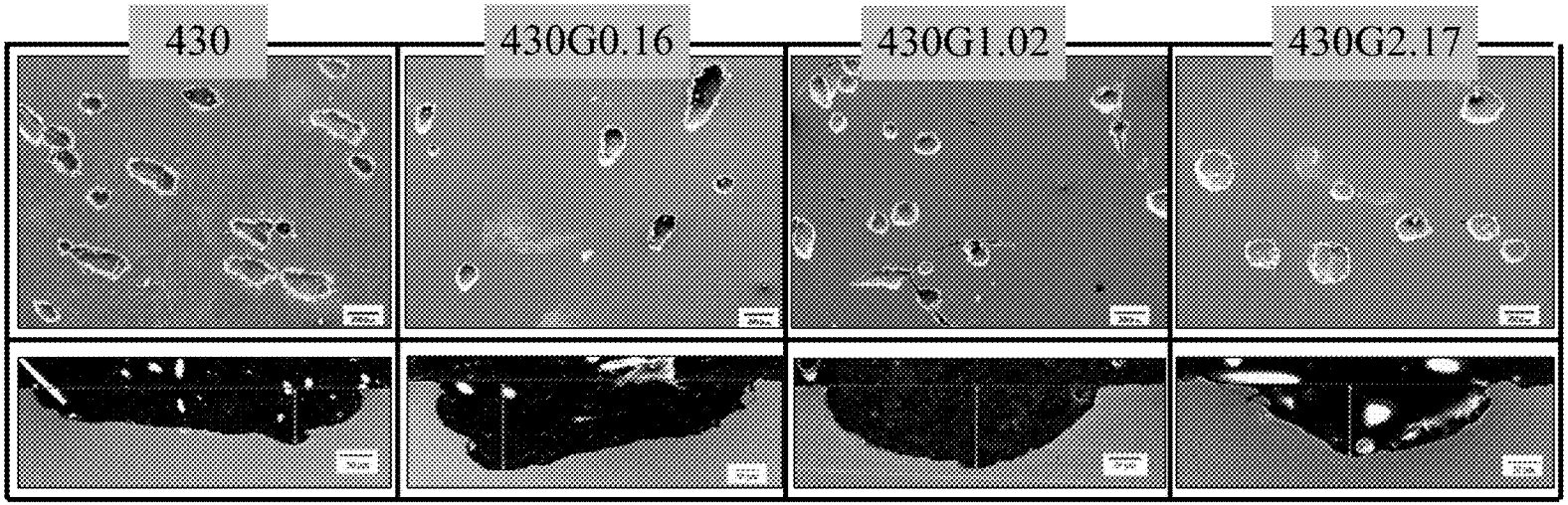
FIG. 5A is a top view and a cross-sectional view of the surface of the Ge-containing stainless steel after corrosion according to the disclosure.
Figure 5B:
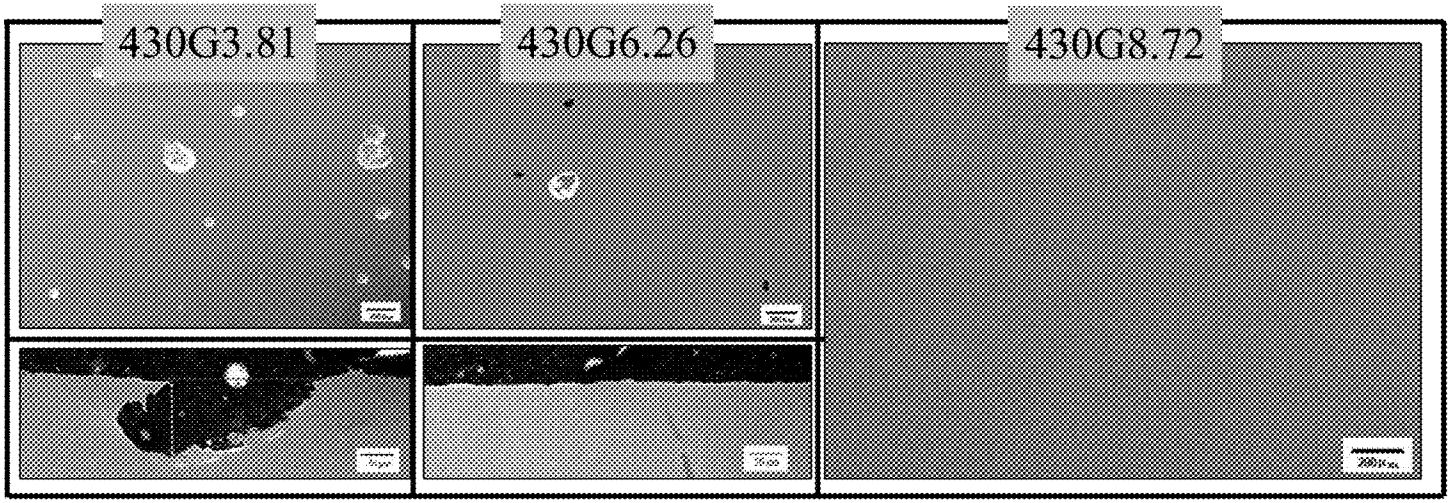
FIG. 5B is a top view and a cross-sectional view of the surface of the Ge-containing stainless steel after corrosion according to the disclosure.

Then, sodium chloride solution is used for the real corrosion tests. As shown in FIGS. 5A~5D, the top view and cross-sectional view are obtained. FIG. 5A shows the absence of germanium addition as well as the addition of germanium lower than 3 wt %. When the addition of germanium is larger, the corrosion rate is slower, as well as the pitting corrosion. With the above in mind, however, both the corrosion rate and the pitting corrosion are still obvious. According to FIG. 5B, when the addition of germanium is higher than 3.81 wt %, not only the corrosion rate is reduced but also the pitting corrosion resistance could improve. The pitting corrosion may totally disappear when the addition of germanium reaches 8.72 wt %.

According to the disclosure, the components to be added include chromium, manganese, silicon, germanium and the rest is iron, wherein the content of chromium is 16~25 wt %. However, the disclosure shows that the adjustment of chromium (which is 0~16 wt %) is beneficial to improve the pitting corrosion resistance. Therefore, the content of chromium can be 0~25 wt %, the content of manganese is 0.1~1 wt %, and the content of silicon is 0.1~1 wt %. In addition, the content of germanium is 0.1~20 wt %. As previously mentioned, when the addition is lower, the effect of lowering the corrosion rate and the pitting corrosion resistance is slight, and when the addition is higher (such as more than 6 wt % germanium being added), the effect is more significant.

According to the Ge-containing stainless steel of the disclosure, as compared with other conventional techniques, there are advantages as the followings:

1. According to the disclosure, Ge-containing stainless steel is made from the main components of iron, chromium, manganese and silicon with the addition of different amount of germanium.

2. According to the disclosure, the addition of a minute amount of germanium could help establish the pitting corrosion resistance. Therefore, the Ge-containing stainless steel of the disclosure is an innovative and the pitting corrosion resistant alloy is different from conventional stainless steels.

Note that the specifications relating to the above embodiments should be construed as exemplary rather than as limitative of the present disclosure. The equivalent variations and modifications on the structures or the process by reference to the specification and the drawings of the disclosure, or application to the other relevant technology fields directly or indirectly should be construed similarly as falling within the protection scope of the disclosure.

What is claimed is:

1. A Ge-containing stainless steel, which is made by melting a raw material consisting of 16 to 25 wt % of Cr, 0.1 to 1 wt % of Mn, 0.1 to 1 wt % of Si, 8.72 to 12 wt % of Ge, and Fe with its weight percentage varying depending on weight percentages of Cr, Mn, Si, and Ge, and then cooling the melted raw material to obtain the Ge-containing stainless steel, wherein the Ge-containing stainless steel has no pitting corrosion when the Ge-containing stainless steel is immersed in a sodium chloride solution.

2. A Ge-containing stainless steel, which is made by melting a raw material consisting of 0 to 16 wt % of Cr, 0.1 to 1 wt % of Mn, 0.1 to 1 wt % of Si, 8.72 to 20 wt % of Ge and Fe with its weight percentage varying depending on weight percentages of Cr, Mn, Si, and Ge, and then cooling the melted raw material to obtain the Ge-containing stainless steel, wherein the Ge-containing stainless steel has no pitting corrosion when the Ge-containing stainless steel is immersed in a sodium chloride solution.

* * * * *